US008894367B2

(12) United States Patent
Lee et al.

(10) Patent No.: US 8,894,367 B2
(45) Date of Patent: Nov. 25, 2014

(54) COMPOUND COOLING FLOW TURBULATOR FOR TURBINE COMPONENT

(75) Inventors: Ching-Pang Lee, Cincinnati, OH (US); Nan Jiang, Jupiter, FL (US); John J. Marra, Winter Springs, FL (US); Ronald J. Rudolph, Jensen Beach, FL (US)

(73) Assignees: Siemens Energy, Inc., Orlando, FL (US); Mikro Systems, Inc., Charlottesville, VA (US)

( * ) Notice: Subject to any disclaimer, the term of this patent is extended or adjusted under 35 U.S.C. 154(b) by 1104 days.

(21) Appl. No.: 12/884,464

(22) Filed: Sep. 17, 2010

(65) Prior Publication Data

US 2011/0033312 A1 Feb. 10, 2011

Related U.S. Application Data

(63) Continuation-in-part of application No. 12/536,869, filed on Aug. 6, 2009, now abandoned.

(51) Int. Cl.
*F01D 5/18* (2006.01)

(52) U.S. Cl.
CPC ..... *F01D 5/187* (2013.01); *F05D 2250/711* (2013.01); *F05D 2250/611* (2013.01); *F05D 2250/60* (2013.01); *F05D 2250/712* (2013.01); *F05D 2260/2212* (2013.01); *F05D 2250/70* (2013.01); *F05D 2260/22141* (2013.01); *F05D 2250/181* (2013.01)
USPC ..... 416/96 R; 416/97 R; 165/109.1; 165/133; 165/183; 165/184

(58) Field of Classification Search
USPC ..... 415/115, 116, 175, 176, 177, 178; 416/95, 96 R, 96 A, 97 R, 235, 236 R, 416/236 A, 237, 228; 165/109.1, 133, 183, 165/184
See application file for complete search history.

(56) References Cited

U.S. PATENT DOCUMENTS

| | | | | |
|---|---|---|---|---|
| 4,514,144 | A | 4/1985 | Lee | |
| 4,974,633 | A * | 12/1990 | Hickey | 416/235 |
| 5,353,865 | A * | 10/1994 | Adiutori et al. | 165/133 |
| 5,577,555 | A * | 11/1996 | Hisajima et al. | 165/133 |
| 5,738,493 | A | 4/1998 | Lee et al. | |
| 5,797,726 | A | 8/1998 | Lee | |
| 5,975,850 | A | 11/1999 | Abuaf et al. | |
| 6,070,657 | A * | 6/2000 | Kunkel | 165/158 |
| 6,331,098 | B1 | 12/2001 | Lee | |
| 6,402,464 | B1 * | 6/2002 | Chiu et al. | 415/116 |

(Continued)

FOREIGN PATENT DOCUMENTS

| | | | |
|---|---|---|---|
| EP | 1043479 | A2 | 10/2000 |
| JP | 59119192 | A | 7/1984 |
| JP | 07190663 | A | 7/1995 |

*Primary Examiner* — Christopher Verdier

(57) ABSTRACT

Multi-scale turbulation features, including first turbulators (46, 48) on a cooling surface (44), and smaller turbulators (52, 54, 58, 62) on the first turbulators. The first turbulators may be formed between larger turbulators (50). The first turbulators may be alternating ridges (46) and valleys (48). The smaller turbulators may be concave surface features such as dimples (62) and grooves (54), and/or convex surface features such as bumps (58) and smaller ridges (52). An embodiment with convex turbulators (52, 58) in the valleys (48) and concave turbulators (54, 62) on the ridges (46) increases the cooling surface area, reduces boundary layer separation, avoids coolant shadowing and stagnation, and reduces component mass.

2 Claims, 5 Drawing Sheets

(56) References Cited

U.S. PATENT DOCUMENTS

| | | | | |
|---|---|---|---|---|
| 6,533,547 | B2 | 3/2003 | Anding et al. | |
| 6,582,584 | B2 | 6/2003 | Lee et al. | |
| 6,598,781 | B2 | 7/2003 | Hasz et al. | |
| 6,932,573 | B2 | 8/2005 | Liang | |
| 6,984,102 | B2 | 1/2006 | Bunker et al. | |
| 7,094,031 | B2 | 8/2006 | Lee et al. | |
| 7,186,084 | B2 | 3/2007 | Bunker et al. | |
| 7,240,289 | B2 | 7/2007 | Naughton et al. | |
| 7,575,414 | B2 | 8/2009 | Lee | |
| 2002/0005274 | A1 | 1/2002 | Beeck et al. | |
| 2004/0040280 | A1* | 3/2004 | Nirmalan et al. | 60/39.511 |
| 2005/0260076 | A1* | 11/2005 | Daux et al. | 416/97 R |
| 2006/0177304 | A1* | 8/2006 | Omori et al. | 415/206 |

* cited by examiner

COMPOUND COOLING FLOW TURBULATOR FOR TURBINE COMPONENT

CROSS-REFERENCE TO RELATED APPLICATIONS

This application is a continuation-in-part of U.S. patent application Ser. No. 12/536,869 filed on 6 Aug. 2009, now abandoned, and incorporated by reference herein.

STATEMENT REGARDING FEDERALLY SPONSORED DEVELOPMENT

Development for this invention was supported in part by Contract Number DE-FC26-05NT42644, awarded by the United States Department of Energy. Accordingly, the United States Government may have certain rights in this invention.

FIELD OF THE INVENTION

This invention relates to turbulators in cooling channels of turbine components, and particularly in gas turbine airfoils.

BACKGROUND OF THE INVENTION

Stationary guide vanes and rotating turbine blades in gas turbines often have internal cooling channels. Cooling effectiveness is important in order to minimize thermal stress on these airfoils. Cooling efficiency is important in order to minimize the volume of air diverted from the compressor for cooling.

One cooling technique uses serpentine cooling channels with turbulators. An example is shown in U.S. Pat. No. 6,533,547. The present invention provides improved turbulators with features at multiple scales in combinations that increase surface area, increase boundary layer mixing, and control boundary layer separation.

BRIEF DESCRIPTION OF THE DRAWINGS

The invention is explained in the following description in view of the drawings that show.

DETAILED DESCRIPTION OF THE INVENTION

Figure 1:
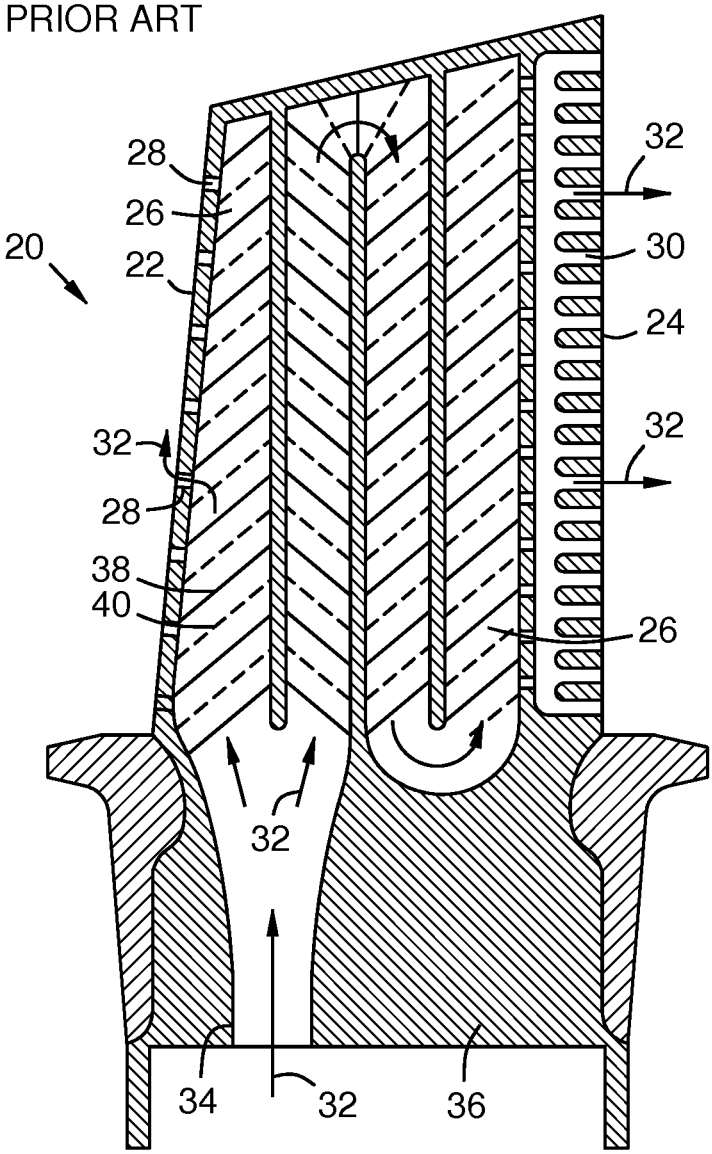
FIG 1 PRIOR ART
FIG. 1 is a sectional view of a prior art turbine blade with serpentine cooling channels and angled ridge turbulators.

FIG. 1 is a side sectional view of a prior art turbine blade 20 with a leading edge 22, a trailing edge 24, cooling channels 26, film cooling holes 28, and coolant exit holes 30. Cooling air 32 enters an inlet channel 34 in the blade dovetail 36. It exits the film holes 28 and trailing edge exit holes 30. Ridge turbulators 38, 40 are provided on the inner surfaces of the cooling channels. These turbulators may be oriented obliquely in the channels 26 as shown, and they may be offset on opposed surfaces of the channels 26. The solid lines 38 represent turbulator ridges visible on the far wall in this viewpoint. The dashed lines represent offset turbulator ridges on the near wall that are not visible in this view.

Figure 2:
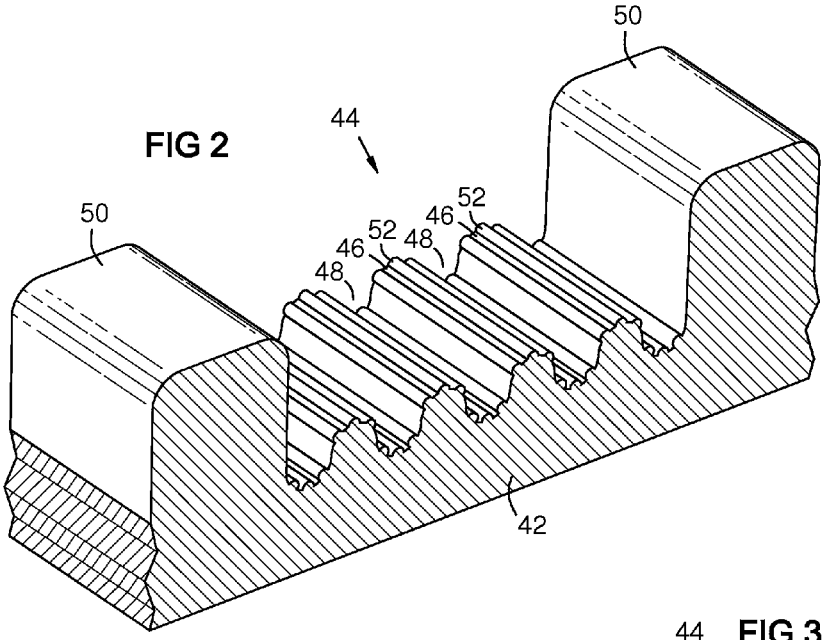
FIG. 2 is a perspective view of part of a component wall, with turbulator ridges at three scales per aspects of the invention.

FIG. 2 is a sectional perspective view of part of a component wall 42 having a cooling channel inner surface 44 with turbulator features at three different scales: 1) A plurality of first parallel ridges 46 separated by valleys 48; 2) Larger ridges 50; and 3) Smaller ridges 52 on each first ridge 46 and in each valley 48. Alternately, not shown, the first ridges 46 may be separated by planar portions of the channel surface 44 rather than by concave valleys 48.

Herein, the terms "larger" and "smaller" refer to relative scales such that a smaller feature has less than ⅓ of the transverse sectional area of a respective "first" feature, and a larger feature has at least 3 times the sectional area of a respective first feature. For example, if a first ridge has a transverse sectional area of 1 $cm^2$, then a respective smaller ridge has a transverse sectional area of less than ⅓ $cm^2$. The term "transverse sectional area" of a bump or dimple is defined as the area of a projection of the bump or dimple onto a plane normal to the channel surface 44 at the apex of the bump or at the bottom of the dimple.

Figure 9:
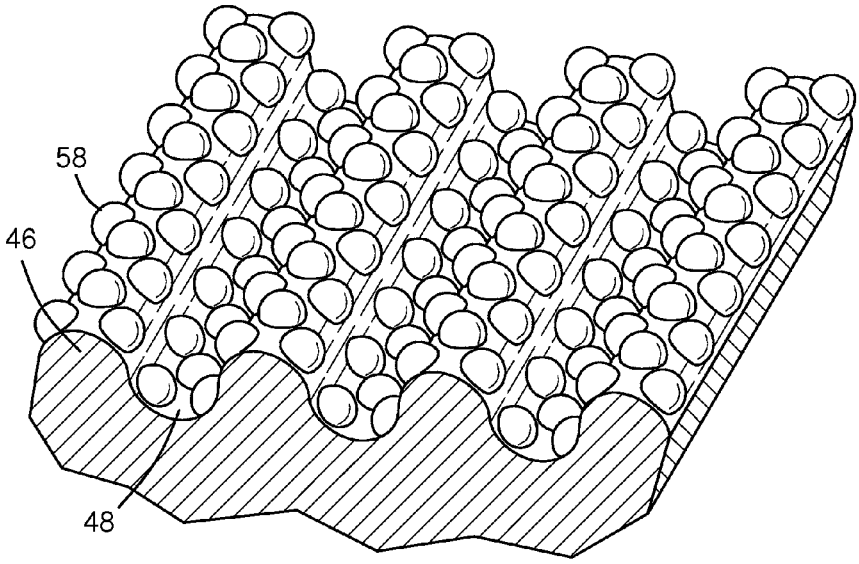
FIG. 9 is a perspective view of turbulator ridges and valleys with bumps.
Figure 10:
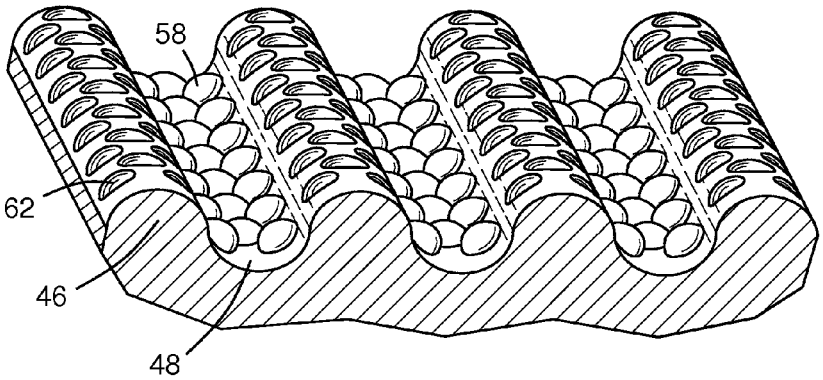
FIG. 10 is a perspective view of turbulator ridges with dimples, and valleys with bumps.

The term "convex turbulation feature" herein includes ridges 46, 50, 51, and 52, and bumps 58. For example FIG. 9 shows a plurality of smaller convex turbulation features 58 on a plurality of first convex turbulation features 46 and on a plurality of first concave turbulation features 48. The term "concave turbulation feature" includes valleys 48, grooves 54, and dimples 62. For example FIG. 10 shows a plurality of smaller concave turbulation features 62 on a plurality of first convex turbulation features 46, and a plurality of smaller convex turbulation features 58 on a plurality of first concave turbulation features 48.

Each additional scale of turbulation features increases the convective area of the channel inner surface 44. For example, if a planar surface is modified with semi-cylindrical ridges separated by tangent semi-cylindrical valleys, the surface area is increased by a factor of about 1.57. If the surfaces of these ridges and valleys are then modified with smaller scale ridges, grooves, bumps, or dimples, the surface area is further increased. In the exemplary configuration of FIG. 2, the first ridges 46 and first valleys 48 increase the surface area by a factor of about 1.57. The smaller ridges 52 further increase it by about 1.27 for a combined factor of about 2. The ridges and valleys may use cylindrical geometries or non-cylindrical geometries such as sinusoidal, rectangular, or other shapes.

Figure 3:
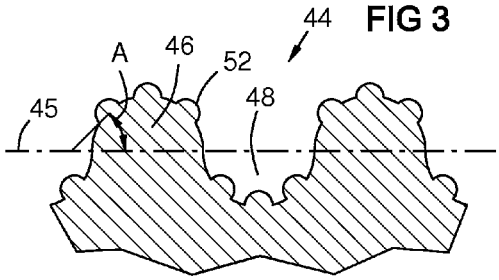
FIG. 3 is a transverse sectional view of two turbulator ridges and a valley between them, with smaller ridges.
Figure 6:
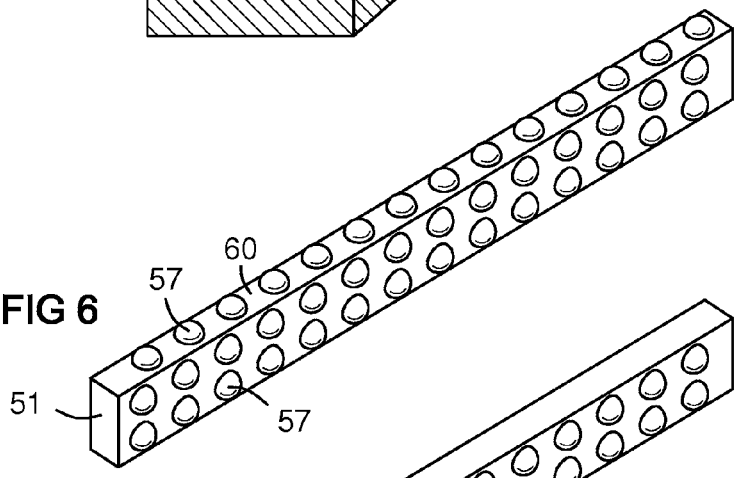
FIG. 6 is a perspective view of a turbulator ridge with bumps on the top and side surfaces.
Figure 7:
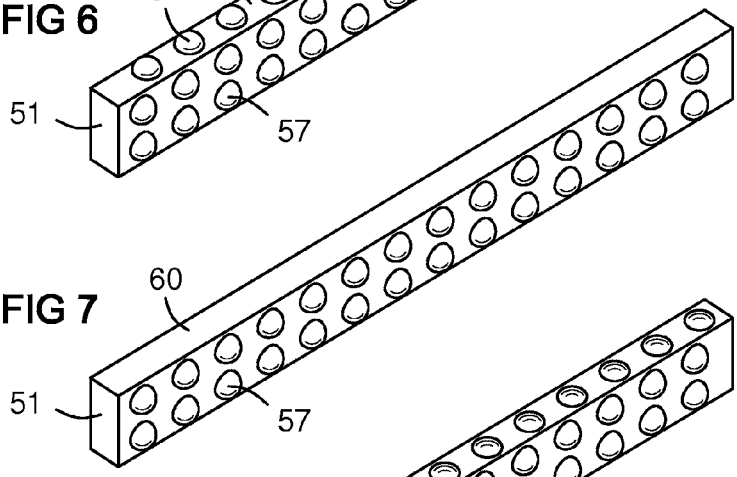
FIG. 7 is a perspective view of a turbulator ridge with bumps only on the side surfaces.
Figure 8:
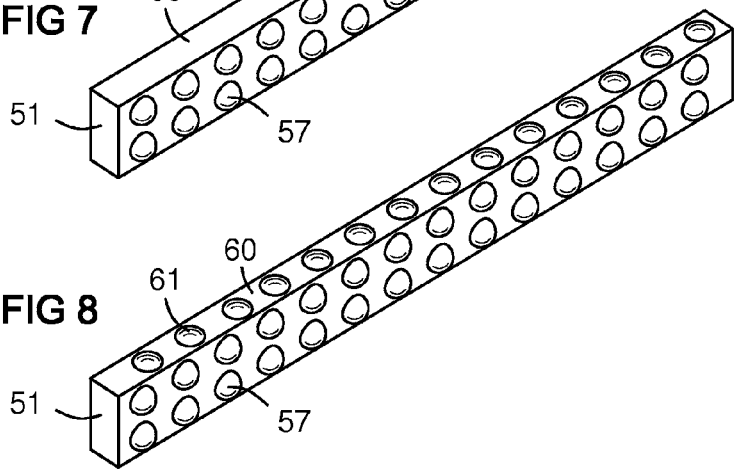
FIG. 8 is a perspective view of a turbulator ridge with dimples on the top surface and bumps on the side surfaces.

Smaller features may be described herein as being on a top or side surface of a first feature. A "top surface" of a turbulator is a surface distal to the cooling surface to which the turbulator is attached, and is generally parallel to or aligned with the cooling surface. On a convex turbulator with a rectangular cross section, the top surface may be a planar surface 60, as shown in FIGS. 6-8. On a convex turbulator with a curved cross section, the top surface is defined as a distal portion of the surface wherein a tangent plane forms an angle "A" of less than 45° relative to a plane 45 of the cooling surface 44 as shown in FIG. 3, wherein plane 45 may be considered as the plane of the cooling surface prior to modification by the turbulation features. This distinction between "top" and "side" surfaces is made because there are benefits to providing different types of smaller features on the top and sides of a turbulator, and/or different types of smaller features on the top and between the first turbulators, as is later described.

Figure 4:
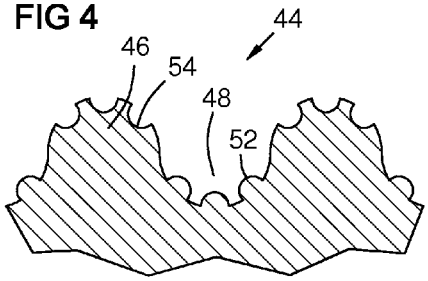
FIG. 4 is a transverse sectional view of two turbulator ridges with smaller grooves, and a valley with smaller ridges.

FIG. 3 is an enlarged sectional view of the first ridges 46, first valleys 48, and smaller ridges 52 of FIG. 2. FIG. 4 shows first ridges 46 with smaller grooves 54, and a first valley 48 with smaller ridges 52. The geometry of FIG. 4 provides the same surface area increase as FIG. 3. However, replacing the smaller ridges 52 on the first ridges 46 with smaller grooves 54 reduces the component mass, and reduces shadowing of the first valleys 48 by the first ridges 46, allowing coolant to more easily reach the bottoms of the first valleys 48.

Alternately forming smaller grooves in the valleys 48 may create some coolant stagnation in some embodiments and is not illustrated here. However, forming smaller convex features on first convex features, and/or forming smaller concave features in first concave features, reduces crowding of the smaller features, since they extend toward the outside of the sectional curvatures of the first features.

Figure 5:
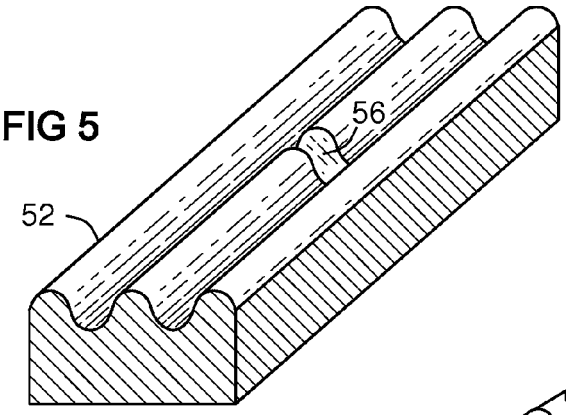
FIG. 5 is a perspective view of a turbulator ridge with a boundary layer restart gap.

FIG. 5 shows a smaller ridge 52 with a gap 56 that restarts the boundary layer of the coolant flow. Such gaps may be provided at any scale—on the first ridges 46, the larger ridges 50, or the smaller ridges 52.

FIG. 6 shows a ridge 51 with smaller bumps 57 on the top surface 60 and sides of the ridge. The bumps add surface area and turbulence. FIG. 7 shows a ridge 51 with smaller bumps 57 on the sides, but not on the top 60 of the ridge. This geometry provides some additional surface area with less additional turbulence than in FIG. 6. The ridges 51 of FIGS. 6-8 may be any scale. For example, the larger ridges 50 of FIG. 2 may have smaller bumps on the sides, and smaller dimples in the top surface in addition to smaller ridges 46 and valleys 48 between the large ridges 50.

FIG. 8 shows a ridge 51 with smaller bumps 57 on the sides, and with smaller dimples 61 on the top surface 60 of the ridge. The smaller dimples 61 add the same amount of surface area as smaller bumps of the same size, but with less mass. Dimples 61 create a type of turbulence that causes the coolant boundary layer to follow the downstream side of the ridge 51 more closely than does a more laminar flow. Thus, smaller dimples on the top surface 60 of the ridge increase coolant contact with any smaller scale features provided between such ridges 51. If the ridges have a tall rectangular sectional shape as shown in FIGS. 6-8, then providing dimples near the base of the ridge may produce some coolant stagnation in some embodiments. A configuration with bumps on the sides, especially near the base, and dimples elsewhere, avoids this.

FIG. 9 shows an embodiment of the invention with first ridges 46 and first valleys 48, both of which are covered with smaller bumps 58. The smaller bumps provide increased surface area and boundary layer mixing. FIG. 10 shows an embodiment of the invention with first ridges 46 and first valleys 48, with smaller dimples 62 on the ridges, and smaller bumps 58 in the valleys. This geometry provides a similar surface increase to that of FIG. 9. However, replacing the smaller bumps 58 on the small ridges 46 with smaller dimples 62 reduces shadowing of the first valleys 48 by the first ridges 46. The smaller dimples add surface area while reducing mass, and they create a type of turbulence that causes the coolant boundary layer to follow the downstream side of the first ridges 46 more closely than would a more laminar flow: Thus, the smaller dimples 62 increase coolant contact with the smaller bumps 58. Providing smaller dimples 62 near the bottom of the first valleys 48 may produce some stagnation in some embodiments, and is not illustrated here, although it may be used as an alternative in order to reduce crowding, as previously mentioned.

Figure 11:
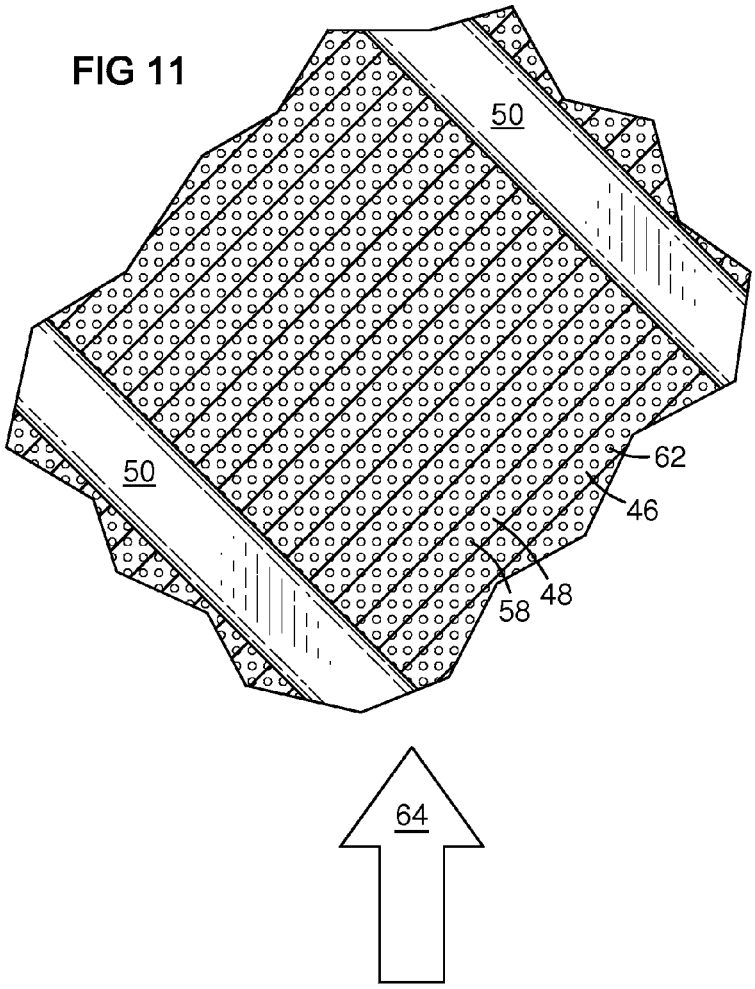
FIG. 11 is a partial plan view of a cooling surface with a plurality of first ridges and valleys, larger ridges perpendicular to the first ridges, and with dimples and bumps on the first ridges and valleys.

FIG. 11 shows an embodiment of the invention with first ridges 46 and first valleys 48 that are perpendicular to the larger ridges 50. Smaller dimples 62 and smaller bumps 58 are disposed on the first ridges 46 and first valleys 48 respectively. A coolant flow 64 is illustrated.

Other combinations of multi-scale turbulation features are possible. For example in FIG. 9, the smaller bumps 58 on the first ridges 46 may be replaced with smaller ridges 52 or the smaller bumps 58 in the first valleys 48 may be replaced with smaller ridges 52. In FIG. 10, the smaller dimples 62 may be replaced with smaller grooves 54.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine component with an interior cooling surface comprising:

a plurality of first convex turbulation features separated by first valleys;

a plurality of concave turbulation features smaller than the first convex turbulation features formed on each of said first convex turbulation feature; and a plurality of second convex turbulation features smaller than the valleys formed on said valleys;

wherein the first convex turbulation features comprise first ridges, and further comprising parallel additional ridges that are larger than the first ridges on the interior cooling surface, wherein the first ridges are formed between and parallel to the additional ridges.

2. The turbine component of claim 1, wherein the concave turbulation features comprises grooves, and the second convex turbulation features comprise second ridges.

* * * * *